US007376367B2

(12) United States Patent
Kim et al.

(10) Patent No.: US 7,376,367 B2
(45) Date of Patent: May 20, 2008

(54) METHOD OF CONTROLLING FUSING SPEED OF IMAGE FORMING APPARATUS

(75) Inventors: Gun-Ho Kim, Seoul (KR); Cheol-ju Yang, Suwon-si (KR); Seung-deog An, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/451,395

(22) Filed: Jun. 13, 2006

(65) Prior Publication Data

US 2006/0285866 A1 Dec. 21, 2006

(30) Foreign Application Priority Data

Jun. 21, 2005 (KR) ..... 10-2005-0053607

(51) Int. Cl.
*G03G 15/20* (2006.01)

(52) U.S. Cl. ..... 399/68; 399/400

(58) Field of Classification Search ..... 399/68, 399/400

See application file for complete search history.

(56) References Cited

U.S. PATENT DOCUMENTS 6,057,869 A * 5/2000 Kawaishi et al. ..... 347/153
6,088,567 A * 7/2000 Miyashiro et al. ..... 399/400

FOREIGN PATENT DOCUMENTS

| | | |
|---|---|---|
| JP | 60-078462 | 5/1985 |
| JP | 61-059368 | 3/1986 |
| JP | 2003-091123 | 3/2003 |
| JP | 2003-098788 | 4/2003 |
| KR | 1995-0019982 | 7/1995 |
| KR | 1998-0083887 | 12/1998 |
| KR | 1020050012027 | 1/2005 |

* cited by examiner

*Primary Examiner*—David M. Gray
*Assistant Examiner*—Bryan Ready
(74) *Attorney, Agent, or Firm*—Roylance, Abrams, Berdo & Goodman, LLP

(57) ABSTRACT

Provided is a method of controlling a fusing speed of an image forming apparatus. Determination is made as to whether a sheet of paper to be printed is a special-purpose sheet. Determination is made as to whether a length 1 of the sheet of paper is shorter than a distance L1 between a second transfer roller and a fusing unit. Determination is also made as to whether the length 1 of the sheet of paper is shorter than a distance L0 between a first transfer roller and the second transfer roller. Determination is made as to whether the length 1 of the sheet of paper is longer than the distance L0 between the first transfer roller and the second transfer roller.

10 Claims, 4 Drawing Sheets

METHOD OF CONTROLLING FUSING SPEED OF IMAGE FORMING APPARATUS

CROSS-REFERENCE TO RELATED PATENT APPLICATION

This application claims the benefit under 35 U.S.C. §119 (a) of Korean Patent Application No. 10-2005-0053607, filed on Jun. 21, 2005, in the Korean Intellectual Property Office, the entire disclosure of which is hereby incorporated by reference.

BACKGROUND OF THE INVENTION

1. Field of the Invention

The present invention relates to a method of controlling a fusing speed of an image forming apparatus. More particularly, the present invention relates to a method of controlling a fusing speed of an image forming apparatus, which controls a conveying speed of a sheet of paper when the fusing speed must vary according to a thickness of the sheet of paper.

2. Description of the Related Art

In general, an image forming apparatus irradiates light onto a photosensitive medium charged to a uniform potential to form an electrostatic latent image corresponding to a desired image on the photosensitive medium. The image forming apparatus develops the electrostatic latent image using toner to form a toner image, and transfers and fuses the toner image onto a sheet of paper, thereby forming a desired image.

A multi-color image forming apparatus generally requires yellow (Y), magenta (M), cyan (C), and black (B) toners. These color toners overlap each other to exhibit a desired multi-color image. Accordingly, the multi-color image forming apparatus requires four developing cartridges for storing respective color toners.

The multi-color image forming apparatus having the four developing cartridges has a larger volume and a more complicated structure than a monochromic image forming apparatus for exhibiting a single color.

In the image forming apparatus, the sheets of paper in a cassette, in which the sheets of paper are loaded, are sequentially conveyed by components, such as a conveying roller, transfer roller, and fusing unit. Then each sheet of paper is ejected by an ejecting unit outside the image forming apparatus. In structural and economical aspects, these components are driven by a driving source, but are not connected to the respective driving sources. That is, at least one driving source is connected to several components. Accordingly, when one driving source operates, many components connected are simultaneously driven.

For example, assuming that a conveying roller, transfer roller, fusing unit, and ejecting unit connected to one driving motor simultaneously operate, when printing is performed on a general-purpose sheet (for example, an A4 size sheet of paper), the sheet passes through the fusing unit and the ejecting unit at a normal speed. Thus, a toner image transferred onto the sheet can be normally fused on the sheet. However, when printing is performed on a special-purpose sheet (for example, an envelope or film), the time required for fusing a toner image on the special-purpose sheet is longer than the time required for the general-purpose sheet.

Accordingly, when the special-purpose sheet passes through the fusing unit at the same speed as the general-purpose sheet, the toner image may not normally be fused on the sheet. If the toner image is not normally fused on the sheet, image quality is adversely affected.

Accordingly, there is a need for an improved method of varying a fusing speed of an image forming apparatus according to a size of a sheet of paper in order to produce a quality toner image on the sheet of paper.

SUMMARY OF THE INVENTION

An aspect of embodiments of the present invention is to address at least the above problems and/or disadvantages and to provide at least the advantages described below. Accordingly, an aspect of embodiments of the present invention is to provide a method of controlling a fusing speed of an image forming apparatus which controls a conveying speed of a sheet of paper passing through a fusing unit according to the sheet of paper type or length in order to maintain reliability of image quality.

According to an aspect of an exemplary embodiment of the present invention, there is provided a method of controlling a fusing speed of an image forming apparatus. A determination is made as to whether a sheet of paper to be printed is a special-purpose sheet. A determination is made as to whether a length 1 of the sheet of paper is shorter than a distance L1 between a second transfer roller and a fusing unit. A determination is also made as to whether the length 1 of the sheet of paper is shorter than a distance L0 between a first transfer roller and the second transfer roller. A determination is made as to whether the length 1 of the sheet of paper is longer than the distance L0 between the first transfer roller and the second transfer roller.

Other objects, advantages, and salient features of the invention will become apparent to those skilled in the art from the following detailed description, which taken in conjunction with the annexed drawings, discloses exemplary embodiments of the invention.

BRIEF DESCRIPTION OF THE DRAWINGS

The above and other objects, features and advantages of certain exemplary embodiments of the present invention will be more apparent from the following description taken in conjunction with the accompanying drawings, in which.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications described herein can be made without departing from the scope and spirit of the invention. Also, descriptions of well-known functions and constructions are omitted for clarity and conciseness.

Figure 1:
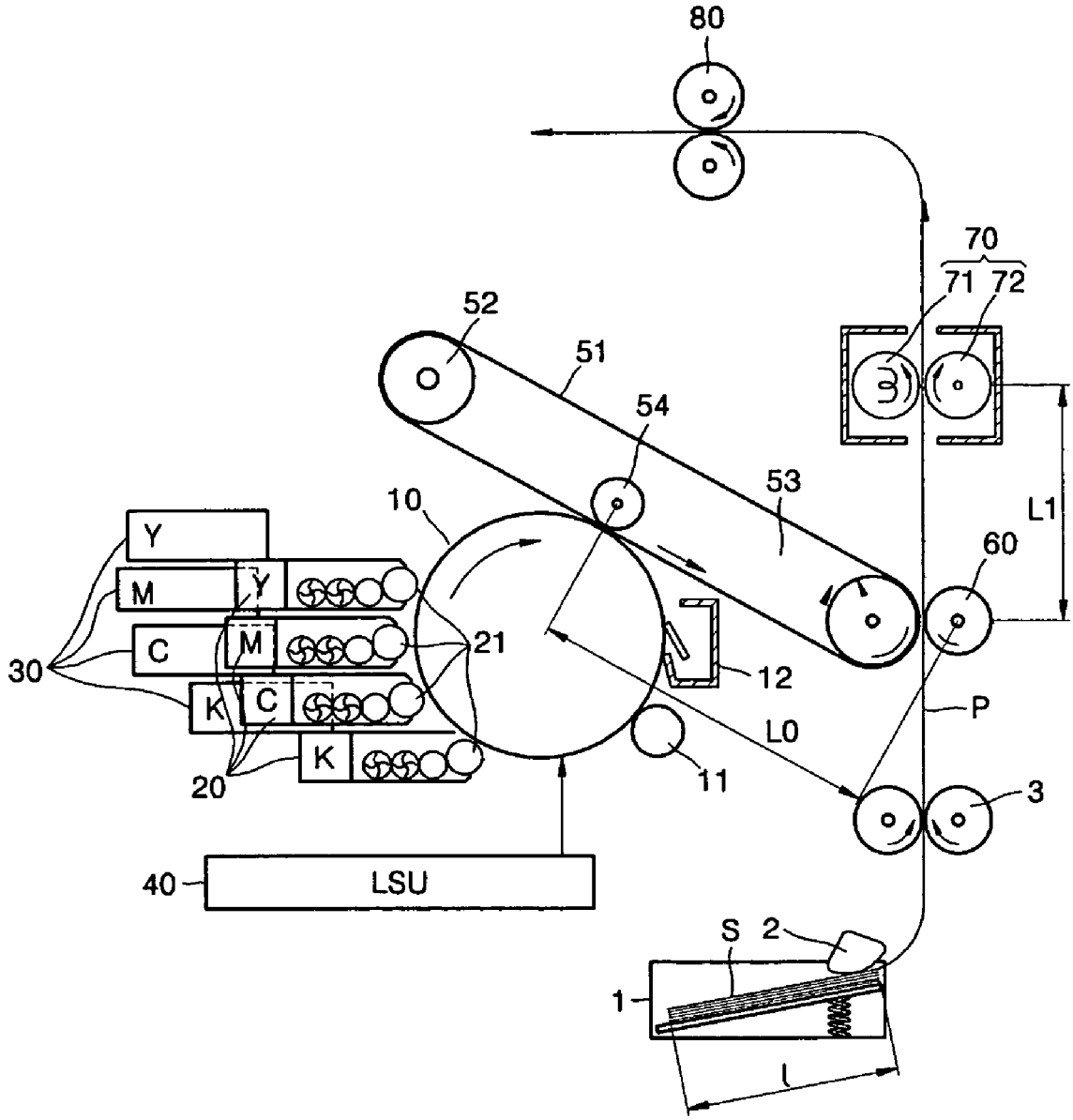
FIG. 1 is a schematic diagram of an electrophotographic image forming apparatus related to the present invention.

Referring to FIG. 1, an image forming apparatus includes a photosensitive drum 10, a plurality of developing cartridges 20, a plurality of toner cartridges 30, an intermediate transfer belt 51, a first transfer roller 54, a second transfer roller 60, a fusing unit 70, and an ejecting unit 80.

The photosensitive drum 10 has a photoconductive layer formed on its outer circumferential surface. Instead of the photosensitive drum 10, a photosensitive belt may be employed. Provided is a charging roller 11, which is an example of a charger, disposed adjacent to the outer circumferential surface of the photosensitive drum 10 for charging the photosensitive drum 10 to a predetermined potential. Also, provided is a cleaning means 12 for removing toner remaining on the photosensitive drum 10 after an image transfer.

The charging roller 11 supplies charges to the photosensitive drum 10 while rotating in contact with or in non-contact with the outer circumferential surface of the photosensitive drum 10, to make the outer circumferential surface of the photosensitive drum 10 have a uniform potential. Instead of the charging roller 11, a corona charger may be employed.

An exposure unit 40 irradiates light corresponding to image information onto the photosensitive drum 10 charged to the uniform potential in order to form an electrostatic latent image. The exposure unit 40 generally includes a laser scanning unit (LSU) using a laser diode as a light source.

The plurality of toner cartridges 30Y, 30M, 30C, and 30K contain color toners of yellow (Y), magenta (M), cyan (C), and black (K), respectively. The plurality of the toner cartridges 30Y, 30M, 30C, and 30K are detachably provided to the plurality of the developing cartridges 20Y, 20M, 20C, and 20K to supply the color toners, respectively.

The plurality of the developing cartridges 20Y, 20M, 20C, and 20K receive the respective color toners from the plurality of the toner cartridges 30Y, 30M, 30C, and 30K to develop the electrostatic latent image formed on the photosensitive drum 10.

Each of the plurality of the developing cartridges 20Y, 20M, 20C, and 20K includes a developing roller 21 spaced by a developing gap from the photosensitive drum 10. It is preferable that the development gap can be several tens or several hundreds of micron.

The electrophotographic image forming apparatus according to an exemplary embodiment of the present invention is a multi-pass type image forming apparatus in which the plurality of the developing cartridges 20Y, 20M, 20C, and 20K sequentially operate to form an image. In this multi-pass type image forming apparatus, a developing bias may be applied to the developing roller 21 of a selected developing cartridge (for example, black developing cartridge 20K) and may not be applied to the developing rollers 21 of the other developing cartridges 20Y, 20M, and 20C or a development preventing bias is applied to the other developing cartridges 20Y, 20M, and 20C. Alternatively, only the developing roller 21K of the selected developing cartridge 20K may rotate, and the developing rollers 21Y, 21M, and 21C of the other developing cartridges 20Y, 20M, and 20C may not rotate.

Figure 2:
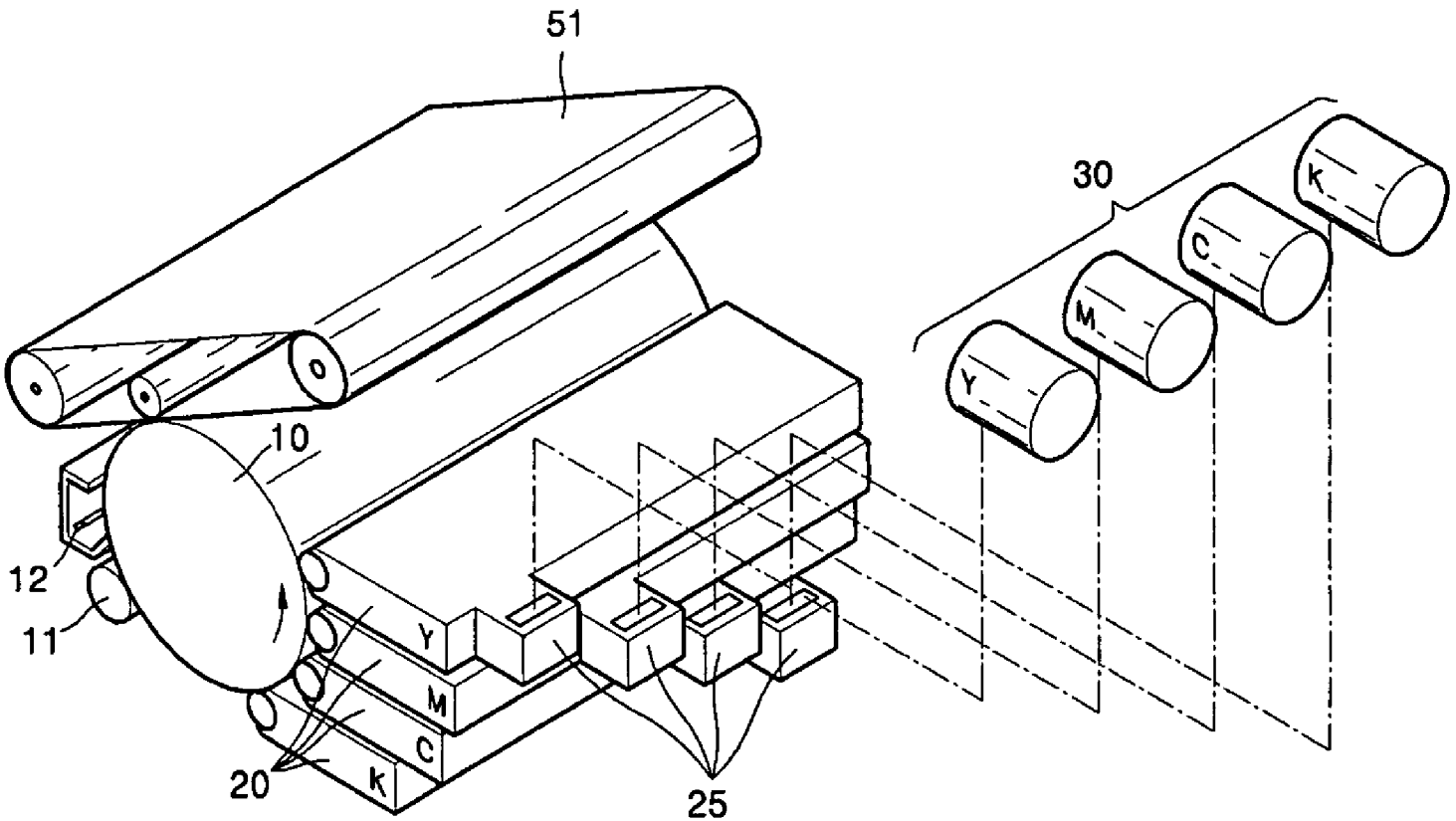
FIG. 2 is a perspective view illustrating arrangement of toner supplying units of a plurality of developing cartridges shown in FIG. 1.

As shown in FIG. 2, the plurality of developing cartridges 20Y, 20M, 20C, and 20K are disposed in parallel in a travel direction of the photosensitive drum 10. Toner supplying units 25 of the plurality of developing cartridges 20Y, 20M, 20C, and 20K are deviated from each other in a lengthwise direction so that the plurality of toner cartridges 30Y, 30M, 30C, and 30K are not interfered with each other.

Since portions of three developing cartridges 20M, 20C, and 20K share heights occupied by the developing cartridges 20Y, 20M, and 20C, an increment of the height of the image forming apparatus can be minimized, due to the plurality of the toner cartridges 30Y, 30M, 30C, and 30K. Also, when the plurality of toner cartridges 30Y, 30M, 30C, and 30K are mounted or dismounted, the toner supplying units 25 may be disposed so that the interference with the plurality of developing cartridges 20Y, 20M, 20C, and 20K or the interference among the plurality of toner cartridges 30Y, 30M, 30C, and 30K is not generated.

The intermediate transfer belt 51 is supported by supporting rollers 52 and 53 and travels at a linear travel speed equal to a linear rotating speed of the photosensitive drum 10. A length of the intermediate transfer belt 51 should be the same or longer than a length of a sheet of paper S having a maximum size, which is used in the image forming apparatus.

The first transfer roller 54 faces the photosensitive drum 10, and is applied with a first transfer bias for transferring the toner image formed on the photosensitive drum 10 onto the intermediate transfer belt 51. The second transfer roller 60 faces the intermediate transfer belt 51. While the toner image is being transferred from the photosensitive drum 10 onto the intermediate transfer belt 51, the second transfer roller 60 is spaced apart from the intermediate transfer belt 51, and when the toner image is completely transferred onto the intermediate transfer belt 51, the second transfer roller 60 contacts the intermediate transfer belt 51 with a predetermined pressure. The second transfer roller 60 is applied with a second transfer bias for transferring the toner image onto the sheet of paper S.

The fusing unit 70 applies heat and pressure to the toner image transferred onto the sheet of paper S in order to fuse the toner image. The fusing unit 70 also includes a heating roller 71 for applying heat and a pressurizing roller 72 for pressurizing the sheet of paper S toward the heating roller 71.

The ejecting unit 80 ejects the sheet of paper S, which the toner image is fused by the fusing unit 70, outside the image forming apparatus.

A distance between the first transfer roller 54 and the second transfer roller 60 is L0, a distance between the second transfer roller 60 and the fusing unit 70 is L1, and a length of the sheet S is 1.

The distance L0 between the first transfer roller 54 and the second transfer roller 60 may be longer or shorter than the distance L1 between the second transfer roller 60 and the fusing unit 70. The present invention can be applied regardless of the sizes of the distances L0 and L1.

The sheet of paper S loaded in cassette 1 of the image forming apparatus is picked up one by one when a pickup roller 2 rotates, conveyed along a conveying path P by a conveying roller 3, and ejected outside the image forming apparatus after the sheet of paper is transferred, fused, and ejected.

Figure 3:
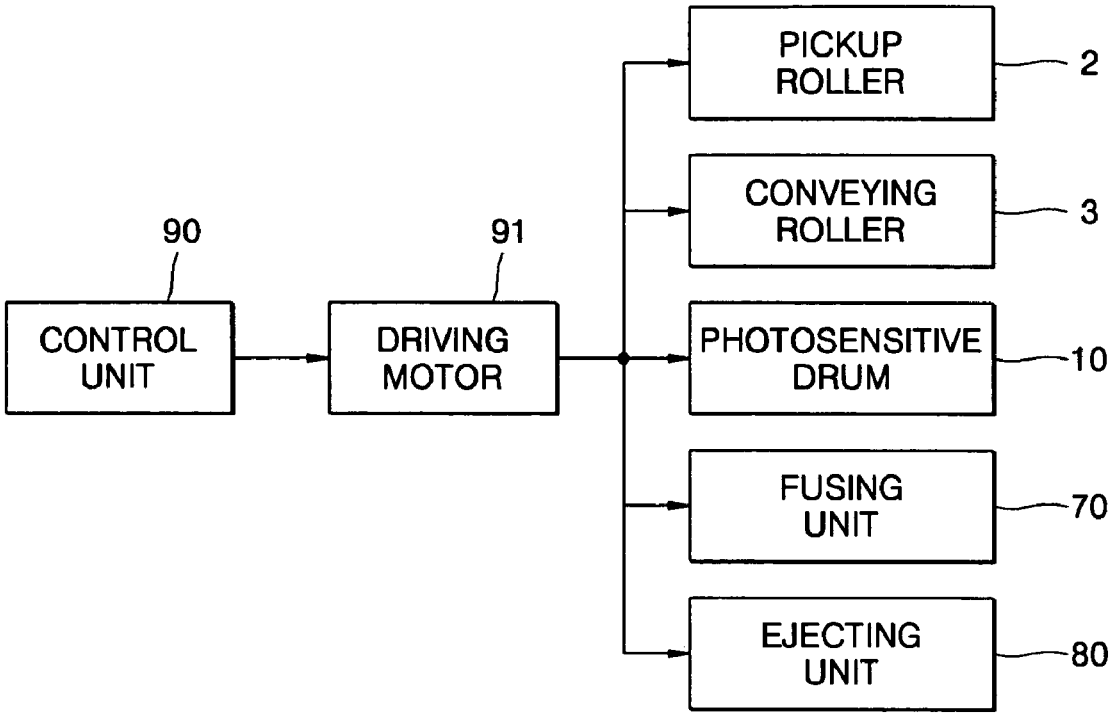
FIG. 3 is a schematic diagram illustrating a power delivering path of a driving motor.

Referring to FIG. 3, the pickup roller 2, conveying roller 3, photosensitive drum 10, fusing unit 70, and ejecting unit 80 are connected to and driven by a driving motor 91. When the driving motor 91 rotates, the pickup roller 2, conveying roller 3, photosensitive drum 10, fusing unit 70, and ejecting unit 80 are driven. The driving motor 91 is connected to and controlled by a control unit 90. As shown in FIG. 1, the first transfer roller 54, supporting roller 53, and second transfer roller 60 are following rollers that rotate to a linear rotating speed of the photosensitive drum 10.

Since the fusing speed varies according to the sheet of paper S, the conveying speed of the sheet of paper S passing through the fusing unit 70 should be controlled according to the length of the sheet of paper S.

However, since all driving rollers, such as the pickup roller 2, conveying roller 3, photosensitive drum 10, fusing unit 70, and ejecting roller 80 are connected to the driving motor 91, when the driving motor 91 speed is reduced, the speed of all the driving rollers are also reduced.

Particularly, when the speed varies during an exposure in the exposure unit 40 or an image transfer from the photosensitive drum, the exposure or image transfer is not performed well. Thus, the image is not completely formed, the image quality is deteriorated, and the print speed is reduced.

Accordingly, the speed of the driving motor 91 must not be reduced during the image transfer (T1 transfer) from the photosensitive drum 10 onto the intermediate transfer belt 51, and the image transfer (T2 transfer) from the intermediate transfer belt 51 onto the sheet of paper S.

Additionally, the speed of the driving motor 91 must be reduced after the image transfer (T1 transfer) from the photosensitive drum 10 onto the intermediate transfer belt 51 and the image transfer (T2 transfer) from the intermediate transfer belt 51 onto the sheet of paper S.

Timing for reducing the speed of the driving motor 91 is determined such that the image quality is maintained and the reduction of the print speed of the image forming apparatus is minimized.

In general, an A4 size sheet of paper S is used as a print sheet. Accordingly, when the A4 sheet of paper S is used, the conveying speed of the sheet of paper S does not need to be controlled.

Figure 4:
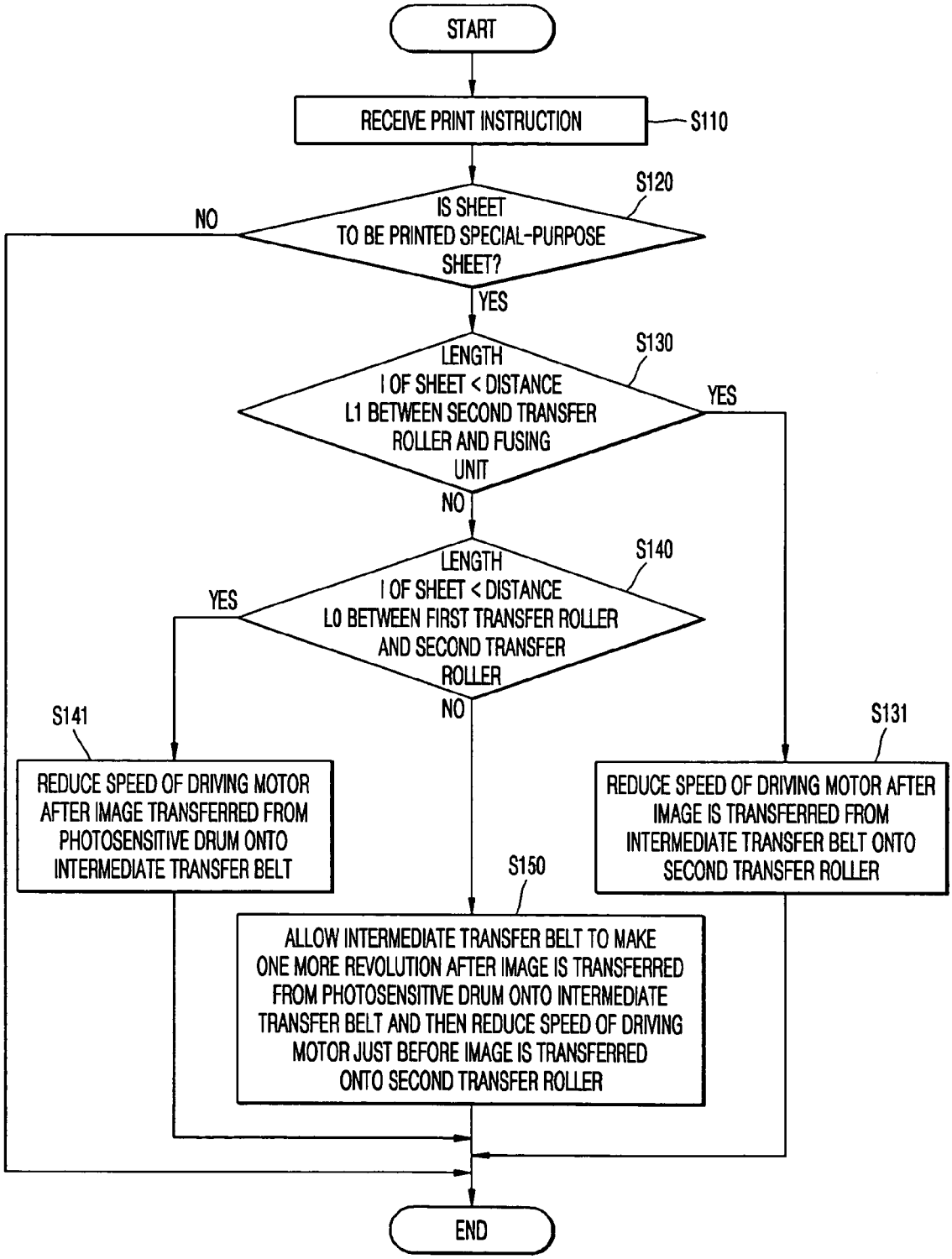
FIG. 4 is a flowchart illustrating a method of controlling a fusing speed according to an exemplary embodiment of the present invention.

Referring to FIG. 4, the image forming apparatus receives a print instruction from a main computer connected through an interface (S110). The print instruction contains various conditions necessary for the printing, such as the A4 size sheet of paper, a special-purpose sheet such as an envelope or OHP, a print range, a number of sheets, a print mode, and magnification or reduction.

The control unit 90 determines whether the sheet of paper S to be printed is the special-purpose sheet such as the envelope or OHP in the various conditions contained in the print instruction (S120).

In operation S120, if the sheet of paper S to be printed is not the special-purpose sheet, the process ends because the speed of the general-purpose sheet does not need to be controlled.

In operation S120, if the sheet of paper S to be printed is the special-purpose sheet, the control unit 90 determines whether the length l of the sheet of paper S is shorter than the distance L1 between the second transfer roller 60 and the fusing unit 70 (S130).

In operation S130, if the control unit 90 determines that the length 1 of the sheet of paper S is shorter than the distance L1 between the second transfer roller 60 and the fusing unit 70, the speed of the driving motor 91 is reduced after the toner image is transferred from the intermediate transfer belt 51 onto the sheet of paper S (T2 transfer) (S131).

Although the speed of the driving motor 91 is reduced after the toner image is transferred from the intermediate transfer belt 51 onto the sheet S (T2 transfer), fusing is performed after the T2 transfer because the length 1 of the sheet of paper S is shorter than the distance L1 between the second transfer roller 60 and the fusing unit 70. Accordingly, if the speed of the driving motor 91 is reduced, the image is transferred well without causing any problem.

Here, reducing the speed of the driving motor 91 is a relative concept based on a conveying speed of the A4 size sheet, which is the general-purpose sheet. Since fusing time of the special-purpose sheet should be longer than the fusing time of the general-purpose sheet, the speed of the special-purpose sheet passing through the fusing unit 70 is slower than the speed of the general-purpose sheet in order to increase the fusing time.

In operation S130, if the control unit 90 determines that the length 1 of the sheet of paper S is longer than the distance L1 between the second transfer roller 60 and the fusing unit 70, a determination is made as to whether the length 1 of the sheet of paper S is shorter than the distance L0 between the first transfer roller 54 and the second transfer roller 60 (S140).

In operation S140, if the control unit 90 determines that the length 1 of the sheet of paper S is shorter than the distance L0 between the first transfer roller 54 and the second transfer roller 60, the speed of the driving motor 91 is reduced after the image is transferred from the photosensitive drum 10 onto the intermediate transfer belt 51 (T1 transfer) (S141).

Accordingly, the toner image can be transferred from the intermediate transfer belt 51 onto the sheet of paper S (second transfer), because the speed of the driving motor 91 is reduced after the image is transferred from the photosensitive drum 10 onto the intermediate transfer belt 51.

In operation S140, if the control unit 90 determines that the length 1 of the sheet of paper S is not shorter than the distance L0 between the first transfer roller 54 and the second transfer roller 60, that is, the length 1 of the sheet of paper S is longer than the distance L0 between the first transfer roller 54 and the second transfer roller 60, the intermediate transfer belt 51 makes one more revolution after the image is transferred from the photosensitive drum 10 onto the intermediate transfer belt 51 (T1 transfer). Then the speed of the driving motor 91 is reduced just before the toner image is transferred from the intermediate transfer belt 51 onto the second transfer roller 60 (second transfer) (S150).

At the timing for reducing the speed of the driving motor 91, the sheet of paper S may enter between the intermediate transfer belt 51 and the second transfer roller 60 in a state in which the image is not transferred from the photosensitive drum 10 onto the intermediate transfer belt 51 (first transfer). Thus, the second transfer can not be performed. In order to prevent the state in which the image is not transferred from the photosensitive drum, after the intermediate transfer belt 51 makes one more revolution to complete the first transfer, the speed of the driving motor 91 is reduced. As a result, the second transfer and fusing is performed at a reduced speed.

As described above, according to the method of controlling the fusing speed of the image forming apparatus of the present invention, by comparing the length of the sheet and the distance between the units, and reducing the speed of the driving motor at an optimal timing to perform the fusing, delay of the print speed of the image forming apparatus, due to the reduction of the fusing speed, can be minimized and reliability of the image quality at the time of the transfer can be improved.

While the invention has been shown and described with reference to exemplary embodiments thereof, it will be understood by those skilled in the art that various changes in form and details may be made therein without departing from the spirit and scope of the invention as defined by the appended claims.

What is claimed is:

1. A method of controlling a fusing speed of an image forming apparatus comprising the steps of:

determining whether a sheet of paper to be printed is a special-purpose sheet or not;

determining whether a length 1 of the sheet of paper is shorter than a distance L1 between a second transfer roller and a fusing unit;

determining whether the length 1 of the sheet of paper is shorter than a distance L0 between a first transfer roller and the second transfer roller, when the length 1 of the sheet of paper is determined to be not shorter than the distance L1 between the second transfer roller and the fusing unit; and controlling the fusing speed and a timing of a fusing speed change in response to at least one of the determining steps.

2. The method according to claim 1, wherein the controlling step comprises reducing a speed of a driving motor after an image is transferred from an intermediate transfer belt onto the second transfer roller, if it is determined that the length 1 of the sheet of paper is shorter than the distance L1 between the second transfer roller and the fusing unit.

3. The method according to claim 1, wherein the controlling step comprises reducing a speed of a driving motor after an image is transferred from a photosensitive drum onto an intermediate transfer belt, if it is determined that the length 1 of the sheet of paper is shorter than a distance L0 between the first transfer roller and the second transfer roller.

4. The method according to claim 1, wherein the controlling step comprises allowing an intermediate transfer belt to make more one revolution after an image is transferred from a photosensitive drum onto an intermediate transfer belt and then reducing a speed of a driving motor before a toner image is transferred from the intermediate transfer belt onto the second transfer roller, if it is determined that the length 1 of the sheet of paper is longer than a distance L0 between the first transfer roller and the second transfer roller.

5. The method according to claim 1, further comprising ending a process of the method if a determination is made that the sheet of paper is not the special-purpose sheet.

6. A computer readable medium for causing a computer to perform a method for controlling a fusing speed of an image forming apparatus, the method comprising the steps of:

determining whether a sheet of paper to be printed is a special-purpose sheet or not;

determining whether a length 1 of the sheet of paper is shorter than a distance L1 between a second transfer roller and a fusing unit;

determining whether the length 1 of the sheet of paper is shorter than a distance L0 between a first transfer roller and the second transfer roller, when the length 1 of the sheet of paper is determined to be not shorter than the distance L1 between the second transfer roller and the fusing unit; and controlling the fusing speed and a timing of a fusing speed change in response to at least one of the determining steps.

7. The computer readable medium according to claim 6, wherein the controlling step comprises reducing a speed of a driving motor after an image is transferred from an intermediate transfer belt onto the second transfer roller, if it is determined that the length 1 of the sheet of paper is shorter than the distance L1 between the second transfer roller and the fusing unit.

8. The computer readable medium according to claim 6, wherein the controlling step comprises reducing a speed of a driving motor after an image is transferred from a photosensitive drum onto an intermediate transfer belt, if it is determined that the length 1 of the sheet of paper is shorter than a distance L0 between the first transfer roller and the second transfer roller.

9. The computer readable medium according to claim 6, wherein the controlling step comprises allowing an intermediate transfer belt to make more one revolution after an image is transferred from a photosensitive drum onto an intermediate transfer belt and then reducing a speed of a driving motor before a toner image is transferred from the intermediate transfer belt onto the second transfer roller, if it is determined that the length 1 of the sheet of paper is longer than a distance L0 between the first transfer roller and the second transfer roller.

10. The computer readable medium according to claim 6, further comprising ending a process of the method if a determination is made that the sheet of paper is not the special-purpose sheet.

* * * * *